US008810502B2

(12) United States Patent
Yu et al.

(10) Patent No.: US 8,810,502 B2
(45) Date of Patent: Aug. 19, 2014

(54) DISPLAY SYSTEM CAPABLE OF SWITCHING TWO-DIMENSIONAL/THREE-DIMENSIONAL MODE AND METHOD THEREOF

(75) Inventors: Tao-Ching Yu, Taoyuan County (TW); Jhen-Shen Liao, Taoyuan County (TW); Yung-Yu Hsieh, Yunlin County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 761 days.

(21) Appl. No.: 13/033,570

(22) Filed: Feb. 23, 2011

(65) Prior Publication Data

US 2012/0162056 A1 Jun. 28, 2012

(30) Foreign Application Priority Data

Dec. 23, 2010 (TW) ..... 99145446 A

(51) Int. Cl.
*G09G 3/36* (2006.01)
*G09G 3/00* (2006.01)

(52) U.S. Cl.
CPC ..... *G09G 3/3688* (2013.01); *G09G 3/003* (2013.01)
USPC ..... 345/102

(58) Field of Classification Search
None
See application file for complete search history.

(56) References Cited

U.S. PATENT DOCUMENTS 7,528,993 B2 5/2009 Rosen
2007/0200792 A1* 8/2007 Kim et al. ..... 345/7
2011/0205335 A1* 8/2011 Kim et al. ..... 348/43

FOREIGN PATENT DOCUMENTS

EP 0 809 391 B1 12/2001
EP 1 235 421 A2 8/2002

* cited by examiner

*Primary Examiner* — Alexander S Beck
*Assistant Examiner* — Kirk Hermann
(74) *Attorney, Agent, or Firm* — Winston Hsu; Scott Margo

(57) ABSTRACT

A display system capable of switching 2D/3D mode includes a signal source, a 3D backlight control signal generation circuit, and a display. The signal source is used for transmitting a vertical synchronization signal and a left eye/right eye control signal. The 3D backlight control signal generation circuit is used for executing a first logic operation on the vertical synchronization signal and the left eye/right eye control signal to output a 3D left eye backlight control signal, and executing a second logic operation on the vertical synchronization signal and the left eye/right eye control signal to output a 3D right eye backlight control signal. The display displays 3D images according to the 3D left eye backlight control signal and the 3D right eye backlight control signal.

7 Claims, 13 Drawing Sheets

DISPLAY SYSTEM CAPABLE OF SWITCHING TWO-DIMENSIONAL/THREE-DIMENSIONAL MODE AND METHOD THEREOF

BACKGROUND OF THE INVENTION

1. Field of the Invention

The present invention is related to a display system capable of switching two-dimensional (2D)/three-dimensional (3D) mode and method thereof, and particularly to a display system capable of switching 2D/3D mode without a microcontroller according to a vertical synchronization signal and a left eye/right eye control signal and method thereof.

2. Description of the Prior Art

Please refer to FIG. 1A and FIG. 1B. FIG. 1A is a diagram illustrating a directional backlight display device 100, and FIG. 1B is a diagram illustrating operation timing of the display device 100. As shown in FIG. 1B, the display device 100 writes left eye data, turns on a left eye backlight source 102, writes right eye data, and turns on a right eye backlight source 104 in turn according to a time-multiplexed principle. The display device 100 continuously repeats the above steps. As shown in FIG. 1A, when the left eye backlight source 102 is turned on, a light guide plate 105 guides backlight transmitted by the left eye backlight source 102 to a 3D thin film 106, and the 3D thin film 106 refracts the backlight to a left eye LE of a user, so that a right eye RE of the user cannot see a left image displayed by a display 108. When a right eye backlight source 104 is turned on, the light guide plate 105 guides backlight transmitted by the right eye backlight source 104 to the 3D thin film 106, and the 3D thin film 106 refracts the backlight of the right eye backlight source 104 to the right eye RE of the user, so that the left eye RE of the user cannot see a right image displayed by the display 108. Therefore, the user can see a 3D image by the above mentioned operation method of the display device 100.

Please refer to FIG. 2. FIG. 2 is a diagram illustrating a directional backlight display device 200 according to the prior art. As shown in FIG. 2, a signal source 202 transmits a vertical synchronization signal VSYNC and a left eye/right eye control signal L/R to a microcontroller 204. The microcontroller 204 generates a 3D left eye backlight control signal 3 DBL or a 2D left eye backlight control signal 2 DBL, and a 3D right eye backlight control signal 3 DBR or a 2D right eye backlight control signal 2 DBR according to the vertical synchronization signal VSYNC and the left eye/right eye control signal L/R to control a left eye backlight source 2062 and a right eye backlight source 2064 of a display device 206 respectively. Please refer to FIG. 3A and FIG. 3B. FIG. 3A is a diagram illustrating timings of the vertical synchronization signal VSYNC, the left eye/right eye control signal L/R, the 2D left eye backlight control signal 2 DBL, and the 2D right eye backlight control signal 2 DBR when the signal source 202 transmits 2D images. FIG. 3B is a diagram illustrating timings of the vertical synchronization signal VSYNC, the left eye/right eye control signal L/R, the 3D left eye backlight control signal 3 DBL, and the 3D right eye backlight control signal 3 DBR when the signal source 202 transmits 3D images. As shown in FIG. 3A, when the signal source 202 transmits the 2D images, the left eye/right eye control signal L/R is the same logic voltage signal. When the vertical synchronization signal VSYNC is triggered, after an image data input interval T1 for writing 2D image data, the 2D left eye backlight control signal 2 DBL and 2D right eye backlight control signal 2 DBR are turned on until the next vertical synchronization signal VSYNC is triggered. As shown in FIG. 3B, when the signal source 202 transmits the 3D images, the left eye/right eye control signal L/R is an alternating logic voltage signal synchronized with the vertical synchronization signal VSYNC. During the left eye image interval of the vertical synchronization signal VSYNC, the left eye/right eye control signal L/R is at a logic-high voltage. After an image data input interval T2 for writing left eye image data, the 3D left eye backlight control signal 3 DBL is turned on until the next vertical synchronization signal VSYNC is triggered. Similarly, during the right eye image interval of the vertical synchronization signal VSYNC, the left eye/right eye control signal L/R is at a logic-low voltage. After the image data input interval T2 for writing right eye image data, the 3D right eye backlight control signal 3 DBR is turned on until the next vertical synchronization signal VSYNC is triggered.

However, the directional backlight display system of the prior art requires the microcontroller to generate the backlight control signal for turning on the backlight source, so that the prior art not only increases cost of the directional backlight display system, but also increases design complexity of the directional backlight display system.

SUMMARY OF THE INVENTION

An embodiment provides a display system capable of switching 2D/3D mode. The display system includes a signal source, a 3D backlight control signal generation circuit, a 2D/3D switching circuit, a 2D backlight control signal generation circuit, a first multiplexer, a second multiplexer, and a display. The signal source is used for transmitting a vertical synchronization signal and a left eye/right eye control signal. The 3D backlight control signal generation circuit is coupled to the signal source for executing a first logic operation on the vertical synchronization signal and the left eye/right eye control signal to output a 3D left eye backlight control signal, and executing a second logic operation on the vertical synchronization signal and the left eye/right eye control signal to output a 3D right eye backlight control signal. The 2D/3D switching circuit is coupled to the signal source for outputting a 2D/3D switching signal according to the vertical synchronization signal and the left eye/right eye control signal. The 2D backlight control signal generation circuit is coupled to the signal source for executing a first logic operation on the vertical synchronization signal and the left eye/right eye control signal to output a 2D left eye backlight control signal and a 2D right eye backlight control signal. The first multiplexer has a first input terminal for receiving the 2D/3D switching signal, a second input terminal for receiving the 2D left eye backlight control signal, a third input terminal for receiving the 3D left eye backlight control signal, and an output terminal for outputting the 2D left eye backlight control signal or the 3D left eye backlight control signal. The second multiplexer has a first input terminal for receiving the 2D/3D switching signal, a second input terminal for receiving the 2D right eye backlight control signal, a third input terminal for receiving the 3D right eye backlight control signal, and an output terminal for outputting the 2D right eye backlight control signal or the 3D right eye backlight control signal. The display is used for displaying 3D images in a 3D mode according to the 3D left eye backlight control signal and the 3D right eye backlight control signal, or displaying 2D images in a 2D mode according to the 2D left eye backlight control signal and the 2D right eye backlight control signal.

Another embodiment provides a 3D mode display method. The display method includes a signal source transmitting a vertical synchronization signal and a left eye/right eye control signal; executing a first logic operation on the vertical synchronization signal and the left eye/right eye control signal to output a 3D left eye backlight control signal, and executing a second logic operation on the vertical synchronization signal and the left eye/right eye control signal to output a 3D right eye backlight control signal; and displaying 3D images in a 3D mode according to the 3D left eye backlight control signal and the 3D right eye backlight control signal.

Another embodiment provides a display method capable of switching 2D/3D mode. The display method includes a signal source transmitting a vertical synchronization signal and a left eye/right eye control signal; outputting a 2D/3D switching signal according to the vertical synchronization signal and the left eye/right eye control signal; executing a first logic operation on the vertical synchronization signal and the left eye/right eye control signal to output a 2D left eye backlight control signal and a 2D right eye backlight control signal; executing a first logic operation on the vertical synchronization signal and the left eye/right eye control signal to output a 3D left eye backlight control signal; executing a second logic operation on the vertical synchronization signal and the left eye/right eye control signal to output a 3D right eye backlight control signal; outputting the 2D left eye backlight control signal or the 3D left eye backlight control signal, and outputting the 2D right eye backlight control signal or the 3D right eye backlight control signal according to the 2D/3D switching signal; and displaying 3D images in a 3D mode according to the 3D left eye backlight control signal and the 3D right eye backlight control signal, or displaying 2D images in a 2D mode according to the 2D left eye backlight control signal and the 2D right eye backlight control signal.

The present invention provides a display system capable of switching 2D/3D mode and method thereof utilize a plurality of simple logic circuits to execute logic operations on a vertical synchronization signal and a left eye/right eye control signal for outputting a 3D left eye backlight control signal and a 3D right eye backlight control signal, or a 2D left eye backlight control signal and a 2D right eye backlight control signal. Therefore, a display displays 3D images according to the 3D left eye backlight control signal and the 3D right eye backlight control signal, or displays 2D images according to the 2D left eye backlight control signal and the 2D right eye backlight control signal. Thus, the present invention not only reduces cost of a directional backlight display system, but also reduces design complexity of the directional backlight display system.

These and other objectives of the present invention will no doubt become obvious to those of ordinary skill in the art after reading the following detailed description of the preferred embodiment that is illustrated in the various figures and drawings.

DETAILED DESCRIPTION

Figure 4:
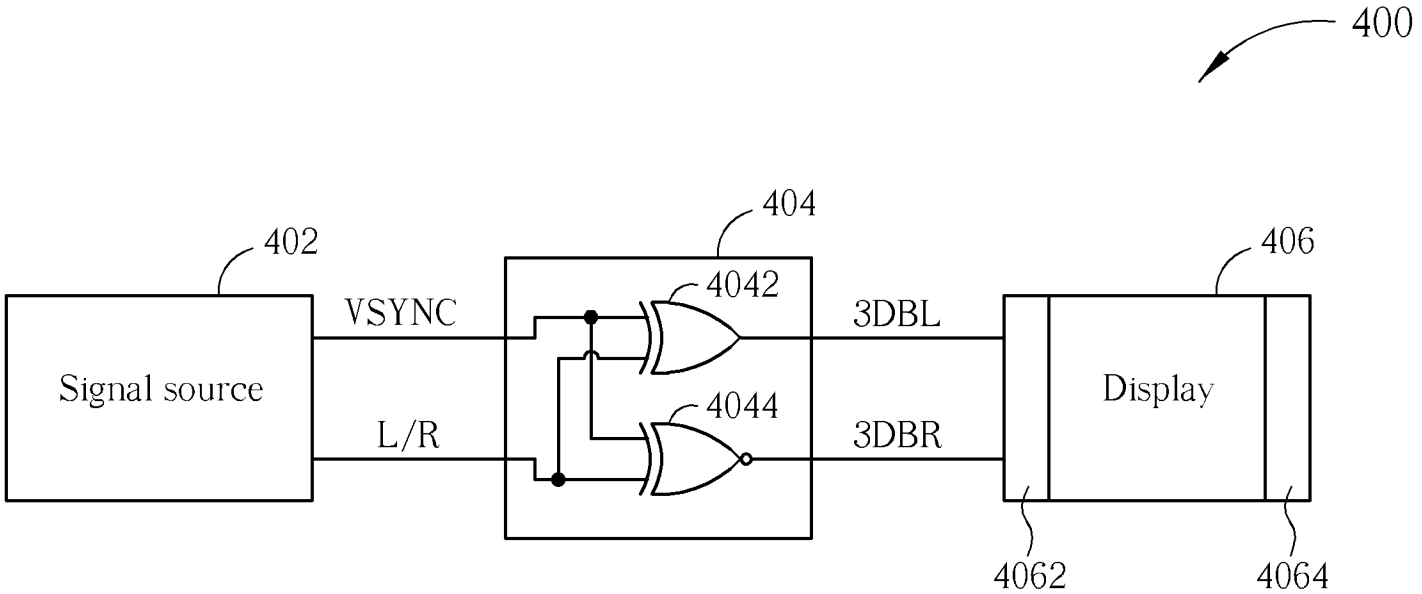
FIG. 4 is a diagram illustrating a 3D mode display system according to an embodiment.

Please refer to FIG. 4. FIG. 4 is a diagram illustrating a 3D mode display system 400 according to an embodiment. The display system 400 includes a signal source 402, a 3D backlight control signal generation circuit 404, and a display 406. The signal source 402 is used for transmitting a vertical synchronization signal VSYNC and a left eye/right eye control signal L/R. The 3D backlight control signal generation circuit 404 is coupled to the signal source 402 for executing a first logic operation on the vertical synchronization signal VSYNC and the left eye/right eye control signal L/R to output a 3D left eye backlight control signal 3 DBL, and executing a second logic operation on the vertical synchronization signal VSYNC and the left eye/right eye control signal L/R to output a 3D right eye backlight control signal 3 DBR. The display 406 is used for displaying 3D images in a 3D mode according to the 3D left eye backlight control signal 3 DBL and the 3D right eye backlight control signal 3 DBR. That is to say, the display 406 turns on a left eye backlight source 4062 and a right eye backlight source 4064 in turn according to the 3D left eye backlight control signal 3 DBL and the 3D right eye backlight control signal 3 DBR for displaying the 3D images.

As shown in FIG. 4, the 3D backlight control signal generation circuit 404 includes an XOR gate 4042 and an XNOR gate 4044. The XOR gate 4042 has a first input terminal for receiving the vertical synchronization signal VSYNC, a second input terminal for receiving the left eye/right eye control signal L/R, and an output terminal. The XOR gate 4042 is used for executing the first logic operation on the vertical synchronization signal VSYNC and the left eye/right eye control signal L/R to output the 3D left eye backlight control signal 3 DBL, where the first logic operation is an exclusive-OR logic operation. The XNOR gate 4044 has a first input terminal for receiving the vertical synchronization signal VSYNC, a second input terminal for receiving the left eye/right eye control signal L/R, and an output terminal. The XNOR gate 4044 is used for executing the second logic operation on the vertical synchronization signal VSYNC and the left eye/right eye control signal L/R to output the 3D right eye backlight control signal 3 DBR, where the second logic operation is an exclusive-NOR logic operation.

Figure 1A:
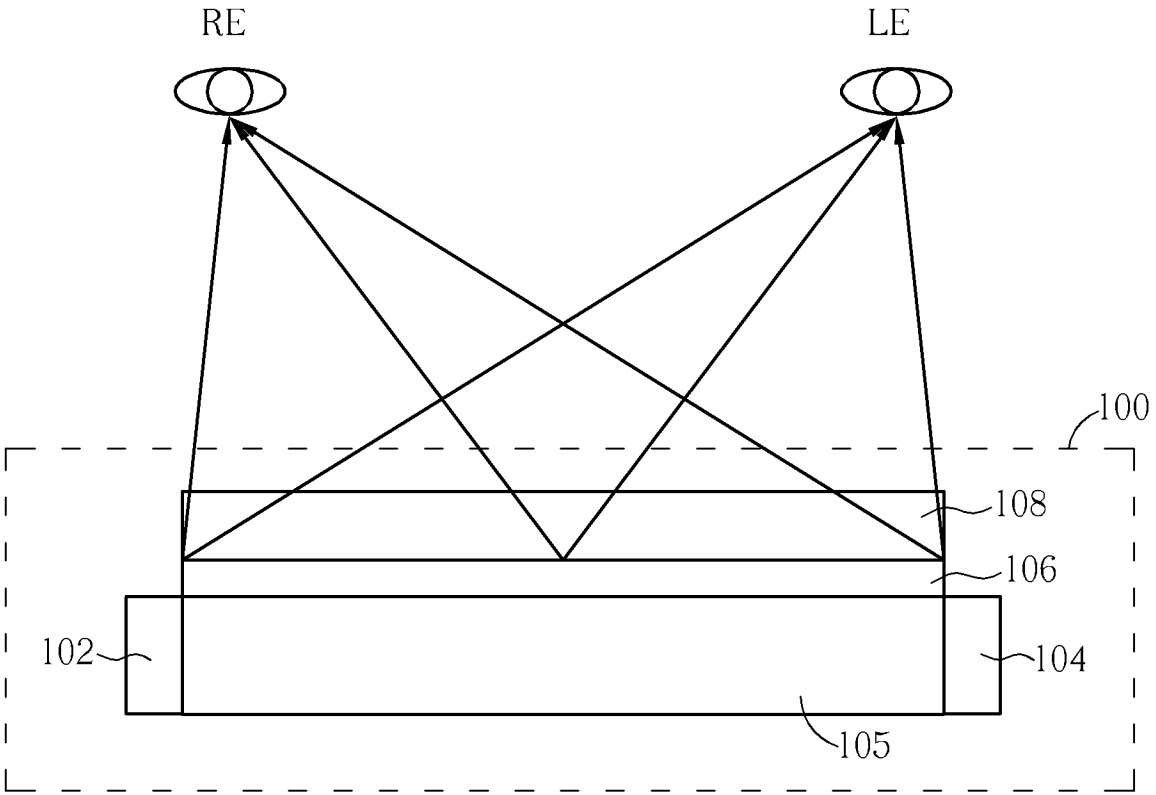
FIG. 1A PRIOR ART
FIG. 1A is a diagram illustrating a directional backlight display device.
Figure 1B:
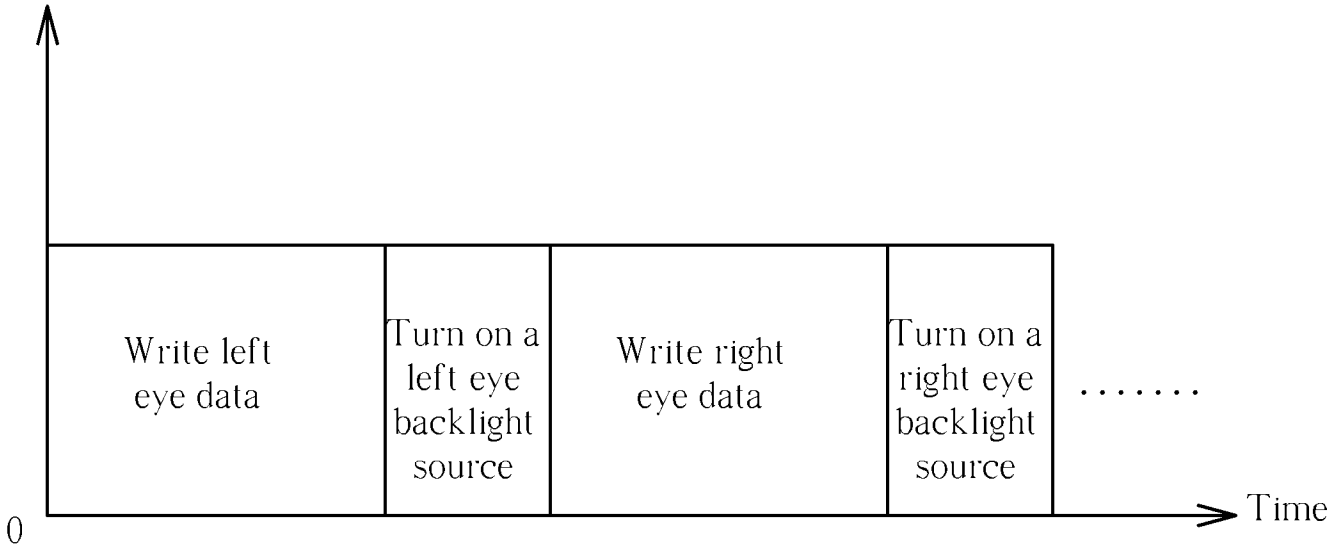
FIG. 1B PRIOR ART
FIG. 1B is a diagram illustrating operation timing of the display device.
Figure 2:
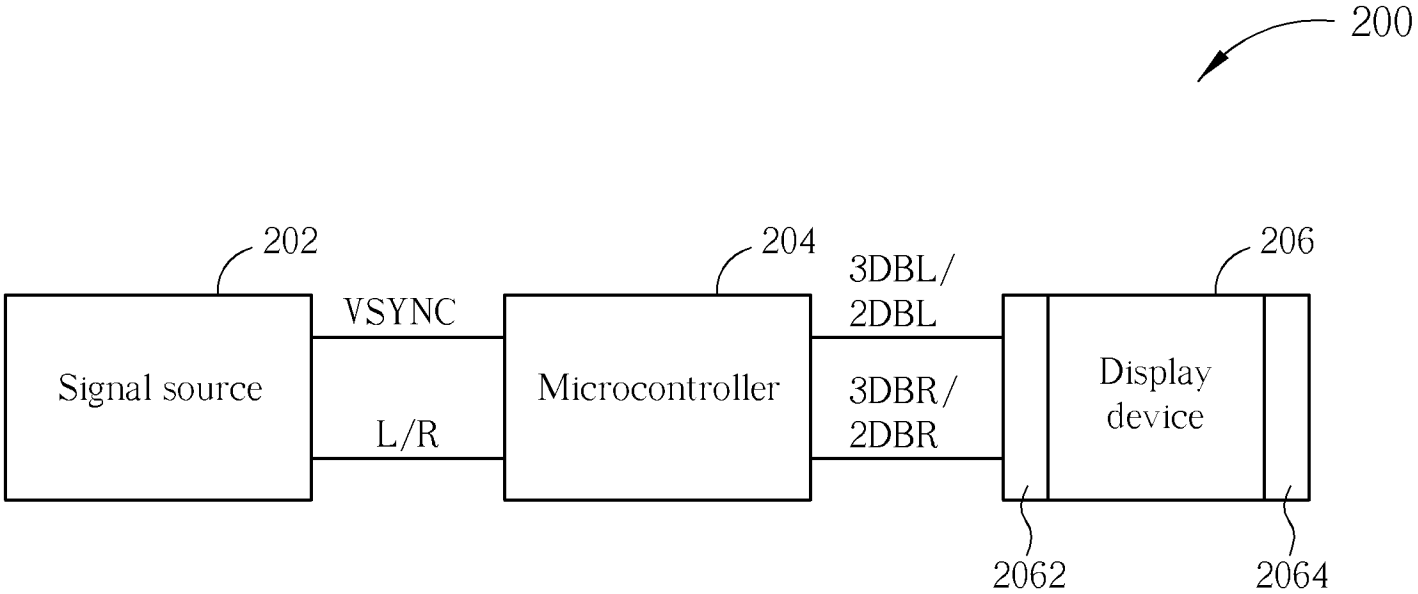
FIG. 2 PRIOR ART
FIG. 2 is a diagram illustrating a directional backlight display device according to the prior art.
Figure 3A:
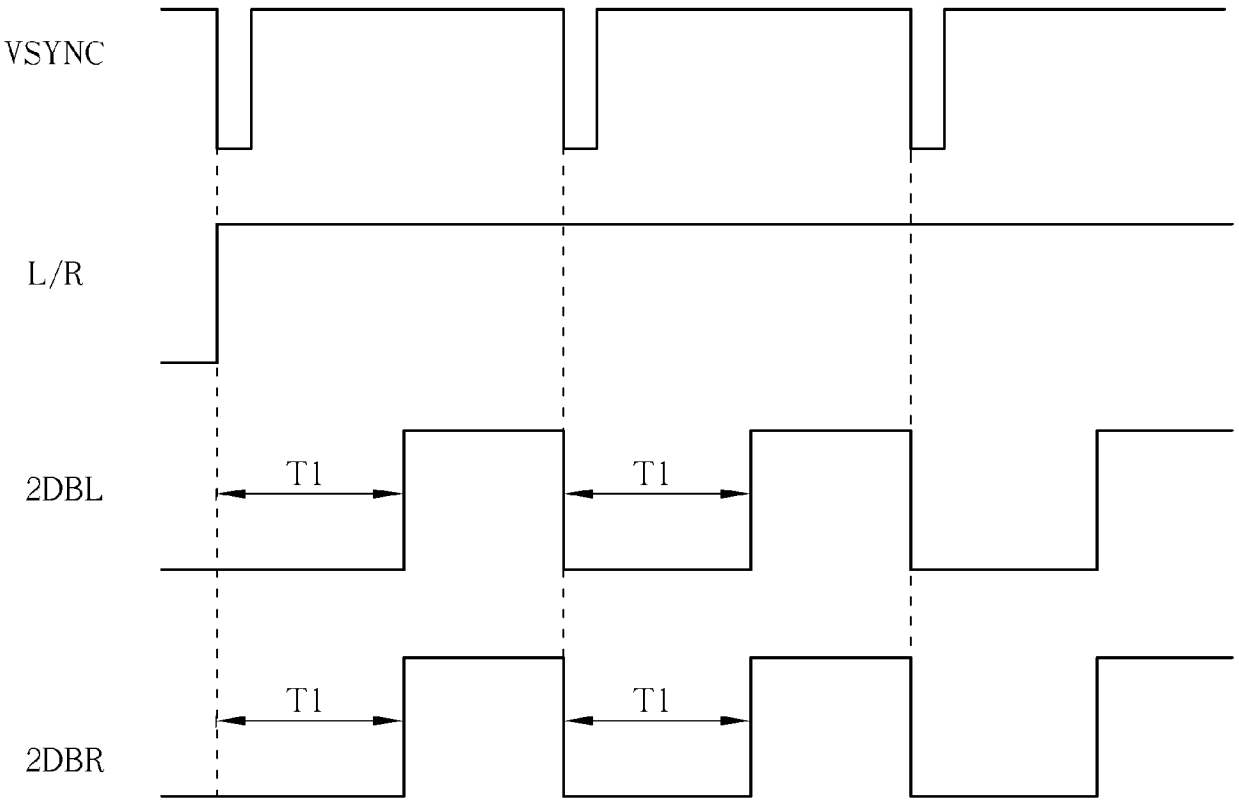
FIG. 3A PRIOR ART
FIG. 3A is a diagram illustrating timings of the vertical synchronization signal, the left eye/right eye control signal, the 2D left eye backlight control signal, and the 2D right eye backlight control signal when the signal source transmits 2D images.
Figure 3B:
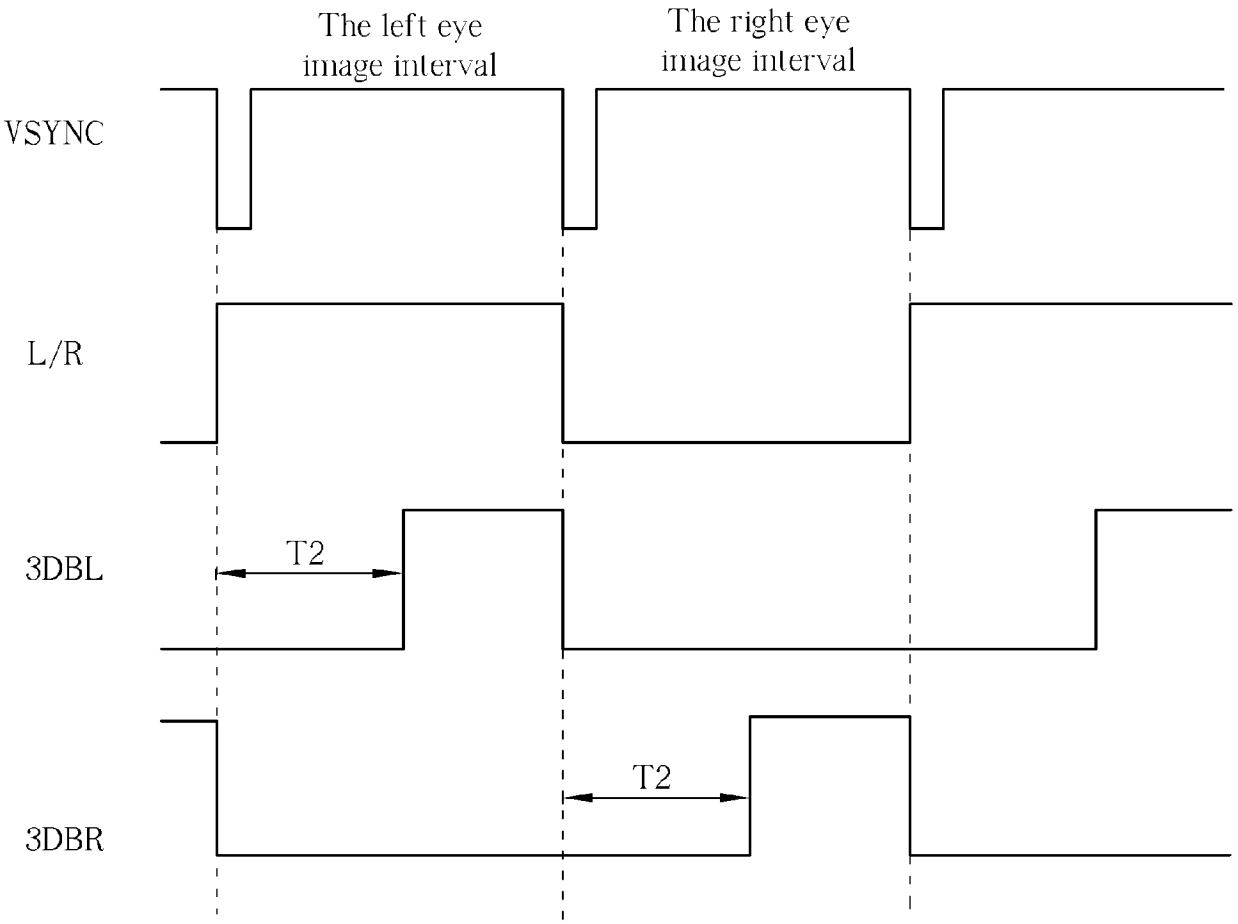
FIG. 3B PRIOR ART
FIG. 3B is a diagram illustrating timings of the vertical synchronization signal, the left eye/right eye control signal, the 3D left eye backlight control signal, and the 3D right eye backlight control signal when the signal source transmits 3D images.
Figure 5:
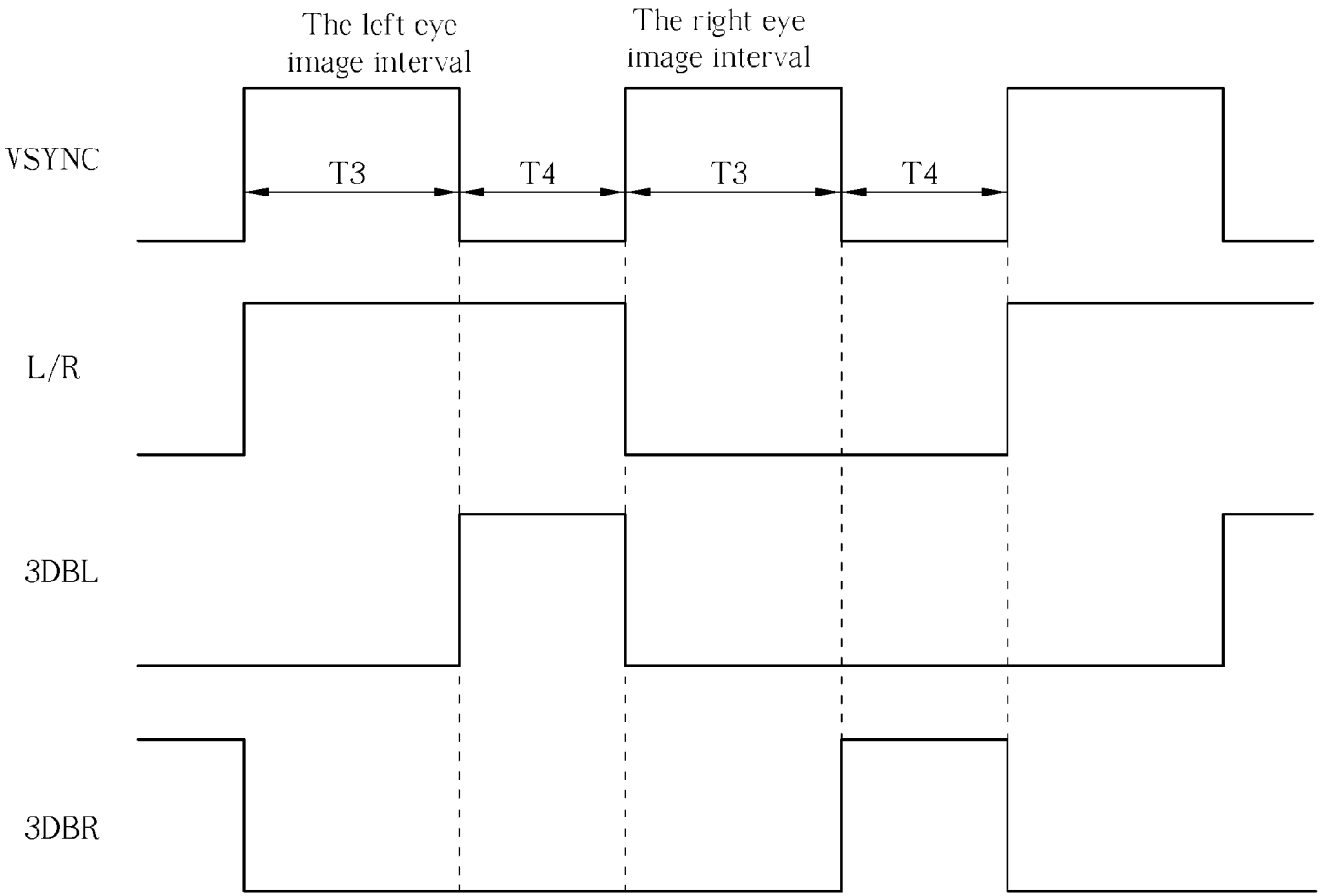
FIG. 5 is a diagram illustrating timings of the vertical synchronization signal, the left eye/right eye control signal, the 3D left eye backlight control signal, and the 3D right eye backlight control signal when the signal source transmits the 3D image.

FIG. 5 is a diagram illustrating timings of the vertical synchronization signal VSYNC, the left eye/right eye control signal L/R, the 3D left eye backlight control signal 3 DBL, and the 3D right eye backlight control signal 3 DBR when the signal source 402 transmits the 3D images. When the signal source 402 transmits the 3D images, the left eye/right eye control signal L/R is an alternating logic voltage signal synchronized with the vertical synchronization signal VSYNC. During the left eye image interval of the vertical synchronization signal VSYNC, the left eye/right eye control signal L/R is at a logic-high voltage. After an image data input interval T3 for writing left eye image data, the 3D left eye backlight control signal 3 DBL is turned on until the beginning of a right eye image interval of the vertical synchronization signal VSYNC. Similarly, during the right eye image interval of the vertical synchronization signal VSYNC, the left eye/right eye control signal L/R is at a logic-low voltage. After the image data input interval T3 for writing right eye image data, the 3D right eye backlight control signal 3 DBL is turned on until a beginning of the left eye image interval of the vertical synchronization signal VSYNC. As shown in FIG. 5, a duty cycle of the vertical synchronization signal VSYNC provided by the embodiment is different from a duty cycle of the vertical synchronization signal VSYNC of FIG. 3A or a duty cycle of the vertical synchronization signal VSYNC of FIG. 3B, and the image data input interval T3 is a sum of image data input time and liquid crystal response time. In FIG. 5, the vertical synchronization signal VSYNC is at the logic-low voltage during a backlight turning-on interval T4. During the left eye image interval, the XOR gate 4042 executes the exclusive-OR logic operation on the vertical synchronization signal VSYNC and the left eye/right eye control signal L/R, and the XNOR gate 4044 executes the exclusive-NOR logic operation on the vertical synchronization signal VSYNC and the left eye/right eye control signal L/R, so only the 3D left eye backlight control signal 3 DBL is at the logic-high voltage and the 3D right eye backlight control signal 3 DBR is at the logic-low voltage during the backlight turning-on interval T4. That is to say, the left eye backlight source 4062 is turned on and the right eye backlight source 4064 is turned off during the left eye image interval. Similarly, during the left eye image interval, the XOR gate 4042 executes the exclusive-OR logic operation on the vertical synchronization signal VSYNC and the left eye/right eye control signal L/R, and the XNOR gate 4044 executes the exclusive-NOR logic operation on the vertical synchronization signal VSYNC and the left eye/right eye control signal L/R, so only the 3D right eye backlight control signal 3 DBR is at the logic-high voltage and the 3D left eye backlight control signal 3 DBL is at the logic-low voltage during the backlight turning-on interval T4. That is to say, the left eye backlight source 4062 is turned off and the right eye backlight source 4064 is turned on during the right eye image interval.

Figure 6:
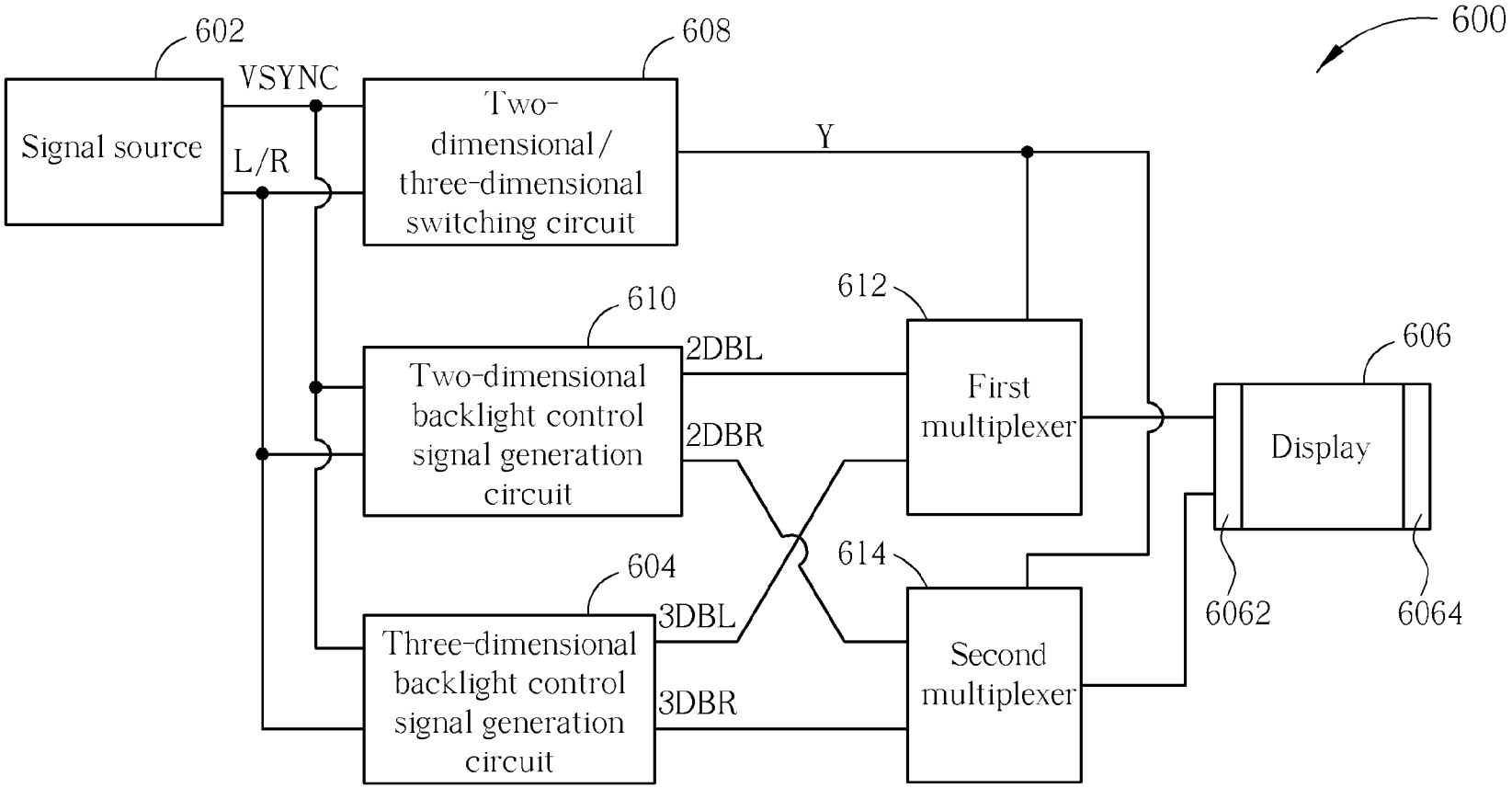
FIG. 6 is a diagram illustrating a display system capable of switching 2D/3D mode according to another embodiment.

Please refer to FIG. 6. FIG. 6 is a diagram illustrating a display system 600 capable of switching 2D/3D mode according to another embodiment. The display system 600 includes a signal source 602, a 3D backlight control signal generation circuit 604, a display 606, a 2D/3D switching circuit 608, a 2D backlight control signal generation circuit 610, a first multiplexer 612, and a second multiplexer 614, where the signal source 602, the 3D backlight control signal generation circuit 604, and the display 606 are the same as the signal source 402, the 3D backlight control signal generation circuit 404, and the display 406, respectively, so further descriptions thereof are omitted for simplicity. The 2D/3D switching circuit 608 is coupled to the signal source 602 for outputting a 2D/3D switching signal Y according to the vertical synchronization signal VSYNC and the left eye/right eye control signal L/R. The 2D backlight control signal generation circuit 610 is coupled to the signal source 602 for executing the first logic operation on the vertical synchronization signal VSYNC and the left eye/right eye control signal L/R to output a 2D left eye backlight control signal 2 DBL and a 2D right eye backlight control signal 2 DBR, where a timing of the 2D left eye backlight control signal 2 DBL is the same as a timing of the 2D right eye backlight control signal 2 DBR. The first multiplexer 612 has a first input terminal coupled to the 2D/3D switching circuit 608 for receiving the 2D/3D switching signal Y, a second input terminal coupled to the 2D backlight control signal generation circuit 610 for receiving the 2D left eye backlight control signal 2 DBL, a third input terminal coupled to the 3D backlight control signal generation circuit 604 for receiving the 3D left eye backlight control signal 3 DBL, and an output terminal. The first multiplexer 612 is used for outputting the 2D left eye backlight control signal 2 DBL or the 3D left eye backlight control signal 3 DBL according to a logic voltage of the 2D/3D switching signal Y. The second multiplexer 614 has a first input terminal coupled to the 2D/3D switching circuit 608 for receiving the 2D/3D switching signal Y, a second input terminal coupled to the 2D backlight control signal generation circuit 610 for receiving the 2D right eye backlight control signal 2 DBR, a third input terminal coupled to the 3D backlight control signal generation circuit 604 for receiving the 3D right eye backlight control signal 3 DBR, and an output terminal. The second multiplexer 614 is used for outputting the 2D right eye backlight control signal 2 DBR or the 3D right eye backlight control signal 3 DBR according to the logic voltage of the 2D/3D switching signal Y. The display 606 is used for displaying 3D images in a 3D mode according to the 3D left eye backlight control signal 3 DBL and the 3D right eye backlight control signal 3 DBR, or displaying 2D images in a 2D mode according to the 2D left eye backlight control signal 2 DBL and the 2D right eye backlight control signal 2 DBR. That is to say, the display 406 turns on a left eye backlight source 6062 and a right eye backlight source 6064 in turn according to the 3D left eye backlight control signal 3 DBL and the 3D right eye backlight control signal 3 DBR for displaying the 3D images, or turns on and turns off the left eye backlight source 6062 and the right eye backlight source 6064 simultaneously according to the 2D left eye backlight control signal 2 DBL and the 2D right eye backlight control signal 2 DBR for displaying the 2D image.

Figure 7:
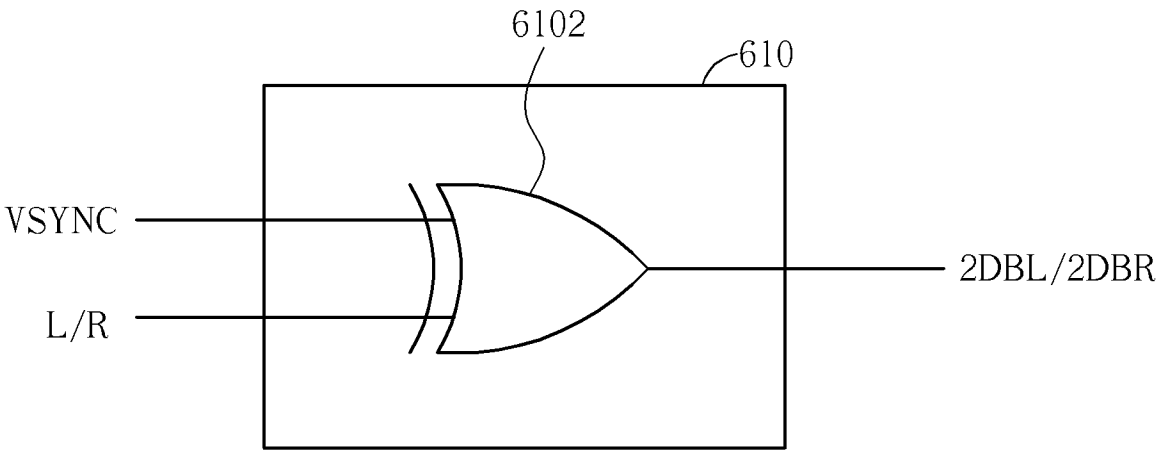
FIG. 7 is a diagram illustrating the 2D backlight control signal generation circuit.
Figure 8:
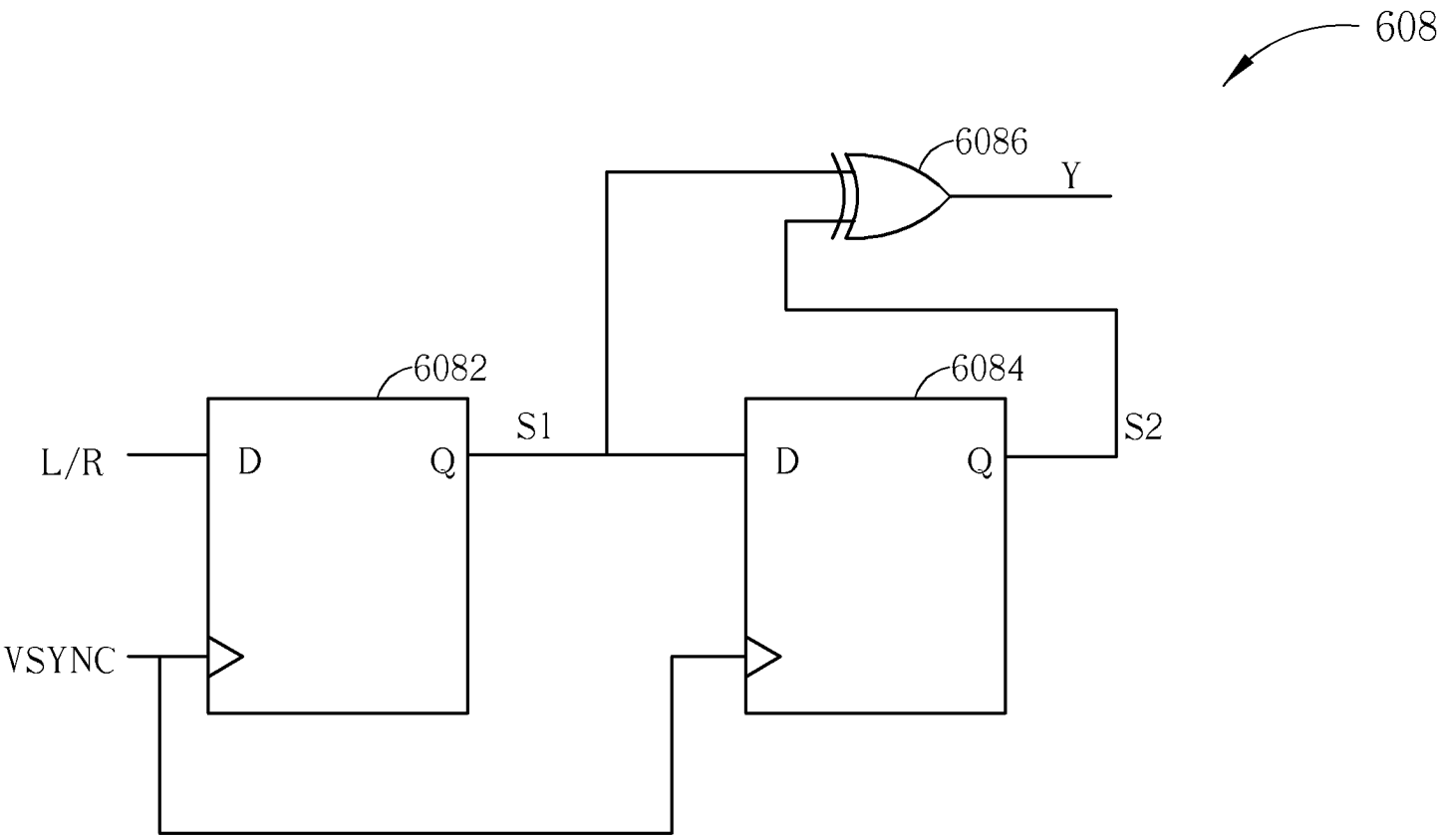
FIG. 8 is a diagram illustrating the 2D/3D switching circuit.
Figure 9:
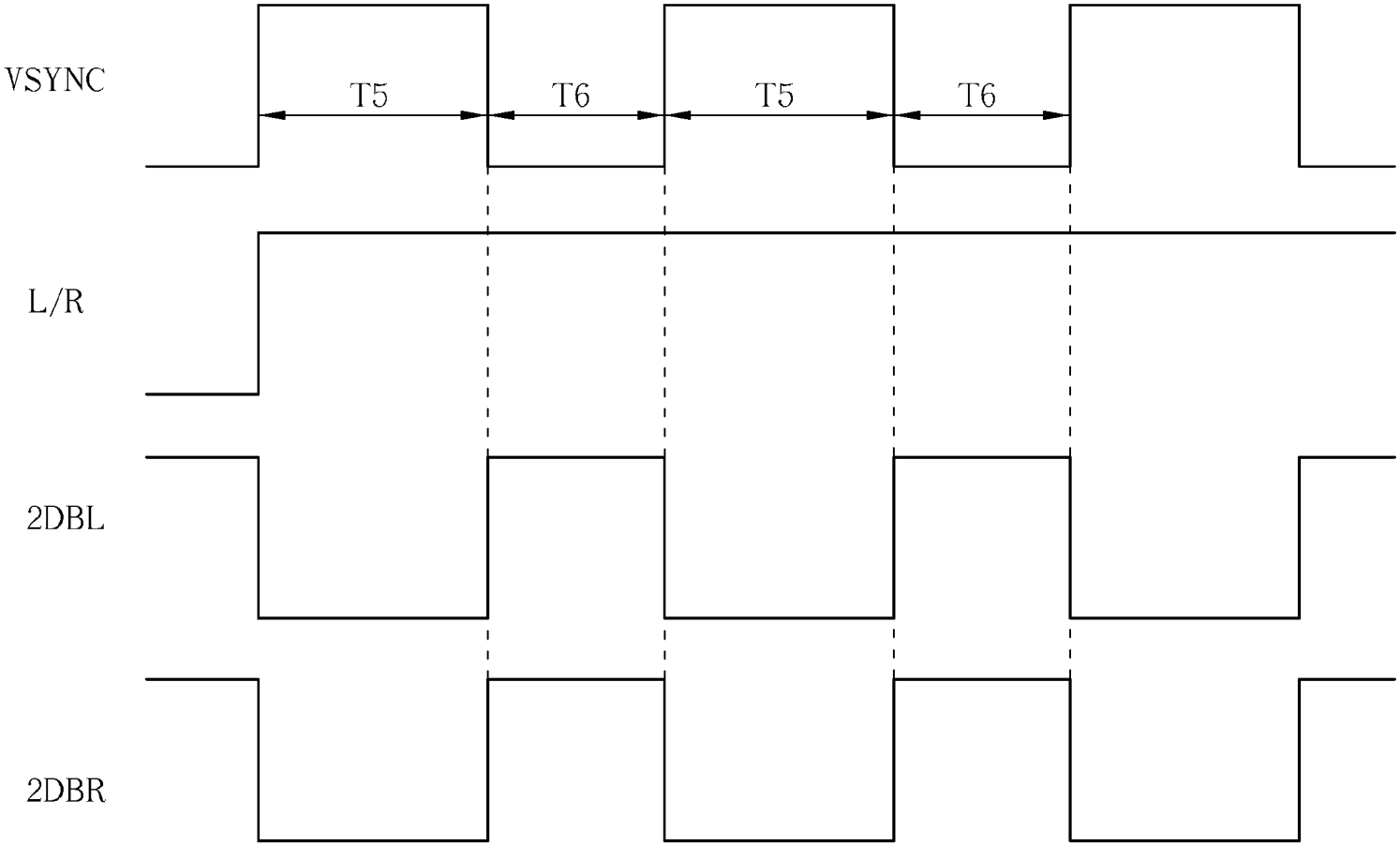
FIG. 9 is a diagram illustrating timings of the vertical synchronization signal, the left eye/right eye control signal, the 2D left eye backlight control signal, and the 2D right eye backlight control signal when the signal source transmits the 2D images.

Please refer to FIG. 7, FIG. 8, and FIG. 9. FIG. 7 is a diagram illustrating the 2D backlight control signal generation circuit 610; FIG. 8 is a diagram illustrating the 2D/3D switching circuit 608; and, FIG. 9 is a diagram illustrating timings of the vertical synchronization signal VSYNC, the left eye/right eye control signal L/R, the 2D left eye backlight control signal 2 DBL, and the 2D right eye backlight control signal 2 DBR when the signal source 602 transmits the 2D images. As shown in FIG. 7, the 2D backlight control signal generation circuit 610 includes a first XOR gate 6102. The first XOR gate 6102 has a first input terminal for receiving the vertical synchronization signal VSYNC, a second input terminal for receiving the left eye/right eye control signal L/R, and an output terminal. The first XOR gate 6102 is used for executing the first logic operation on the vertical synchronization signal VSYNC and the left eye/right eye control signal L/R to output the 2D left eye backlight control signal 2 DBL and the 2D right eye backlight control signal 2 DBR.

As shown in FIG. 8, the 2D/3D switching circuit 608 includes a first flip-flop 6082, a second flip-flop 6084, and a second XOR gate 6086. The first flip-flop 6082 has a first input terminal for receiving the left eye/right eye control signal L/R, a second input terminal for receiving the vertical synchronization signal VSYNC, and a first output terminal for outputting a first signal S1. The second flip-flop 6084 has a first input terminal for receiving the first signal S1, a second input terminal for receiving the vertical synchronization signal VSYNC, and a first output terminal for outputting a second signal S2. The second XOR gate 6086 has a first input terminal for receiving the first signal S1, a second input terminal for receiving the second signal S2, and an output terminal for outputting the 2D/3D switching signal Y, where both the first flip-flop 6082 and the second flip-flop 6084 utilize the vertical synchronization signal VSYNC as clock signals, and are D flip-flops. When a logic voltage of the vertical synchronization signal VSYNC changes from the logic-low voltage "0" to the logic-high voltage "1", an output signal of the first flip-flop 6082 is equal to an input signal, and an output signal of the second flip-flop 6084 is equal to an input signal. Therefore, when a logic voltage of the left eye/right eye control signal L/R is not changed (2D mode), the output signal of the first flip-flop 6082 is equal to the output signal of the second flip-flop 6084, resulting in a logic voltage of the 2D/3D switching signal Y outputted by the second XOR gate 6086 being the logic-low voltage "0". Similarly, when the logic voltage of the left eye/right eye control signal L/R is changed (3D mode), the output signal of the first flip-flop 6082 is different from the output signal of the second flip-flop 6084, resulting in the logic voltage of the 2D/3D switching signal Y outputted by the second XOR gate 6086 being the logic-high voltage "1". Thus, the first multiplexer 612 of FIG. 6 can output the 2D left eye backlight control signal 2 DBL or the 3D left eye backlight control signal 3 DBL according to the logic voltage of the 2D/3D switching signal Y, and the second multiplexer 614 can output the 2D right eye backlight control signal 2 DBR or the 3D right eye backlight control signal 3 DBR according to the logic voltage of the 2D/3D switching signal Y.

As shown in FIG. 9, because the left eye/right eye control signal L/R maintains the same logic voltage (logic-high voltage), both the 2D left eye backlight control signal 2 DBL and the 2D right eye backlight control signal 2 DBR are at the logic-low voltage during an image data input interval T5 (the vertical synchronization signal VSYNC is at the logic-high voltage), resulting in the left eye backlight source 6062 and the right eye backlight source 6064 being turned off, where the image data input interval T5 is a sum of image data input time and the liquid crystal response time. Similarly, during a backlight turning-on interval T6 (the vertical synchronization signal VSYNC is at the logic-low voltage), the 2D backlight control signal generation circuit 610 outputs the logic-high voltage 2D left eye backlight control signal 2 DBL and the logic-high voltage 2D right eye backlight control signal 2 DBR to turn on the left eye backlight source 6062 and the right eye backlight source 6064 simultaneously. Therefore, when the signal source 602 transmits the 2D images, the left eye backlight source 6062 and the right eye backlight source 6064 are turned on and turned off simultaneously.

Figure 10:
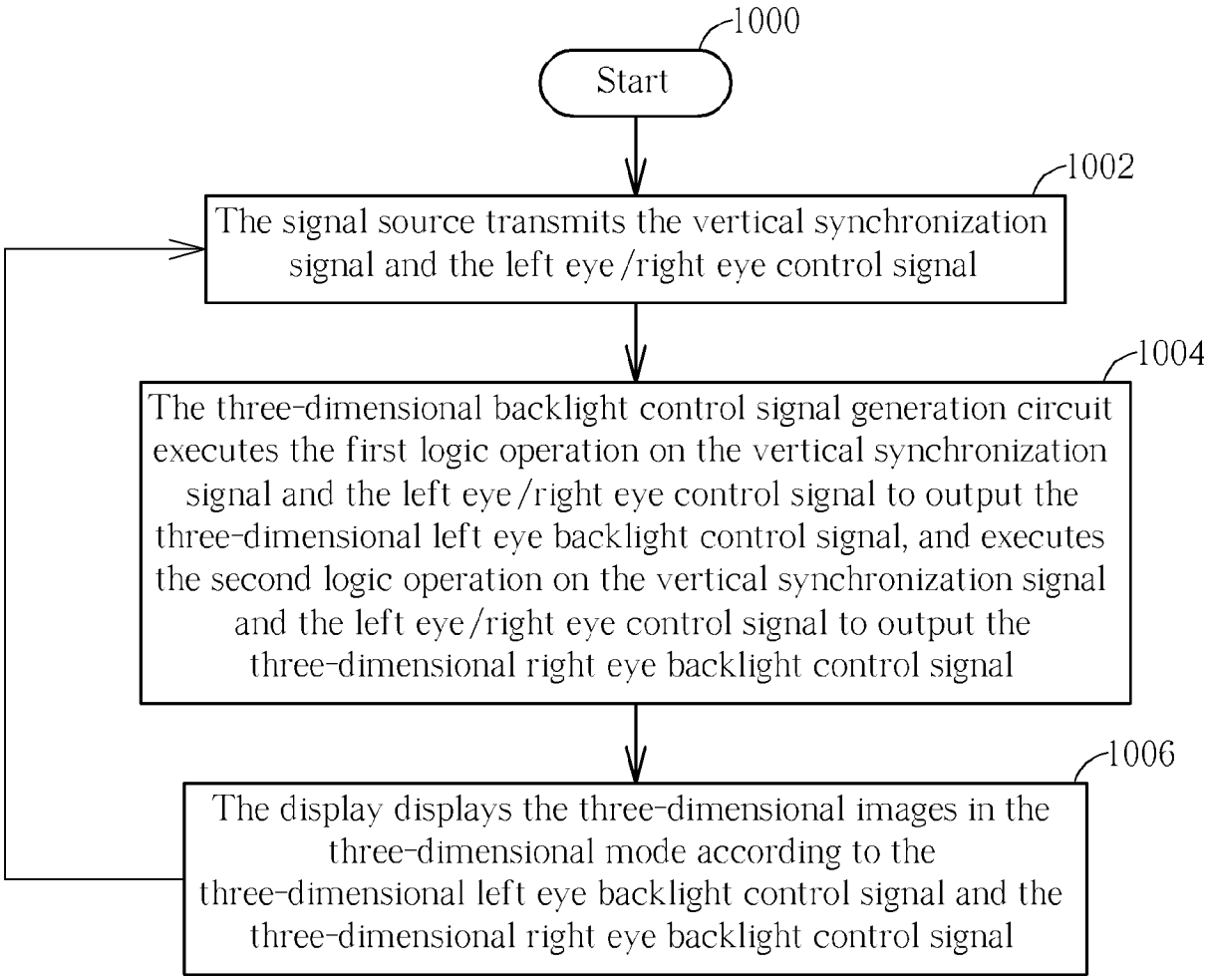
FIG. 10 is a flowchart illustrating a 3D mode display method according to another embodiment.

Please refer to FIG. 10. FIG. 10 is a flowchart illustrating a 3D mode display method according to another embodiment. The method in FIG. 10 uses the display system 400 in FIG. 4 to illustrate the method. Detailed steps are as follows:

Step 1000: Start.

Step 1002: The signal source 402 transmits the vertical synchronization signal VSYNC and the left eye/right eye control signal L/R.

Step 1004: The 3D backlight control signal generation circuit 404 executes the first logic operation on the vertical synchronization signal VSYNC and the left eye/right eye control signal L/R to output the 3D left eye backlight control signal 3 DBL, and executes the second logic operation on the vertical synchronization signal VSYNC and the left eye/right eye control signal L/R to output the 3D right eye backlight control signal 3 DBR.

Step 1006: The display 406 displays the 3D images in the 3D mode according to the 3D left eye backlight control signal 3 DBL and the 3D right eye backlight control signal 3 DBR; go to Step 1002.

In Step 1004, the XOR gate 4042 of the 3D backlight control signal generation circuit 404 executes the exclusive-OR logic operation on the vertical synchronization signal VSYNC and the left eye/right eye control signal L/R to output the 3D left eye backlight control signal 3 DBL, and the XNOR gate 4044 of the 3D backlight control signal generation circuit 404 executes the exclusive-NOR logic operation on the vertical synchronization signal VSYNC and the left eye/right eye control signal L/R to output the 3D right eye backlight control signal 3 DBR. In Step 1006, the display 406 turns on the left eye backlight source 4062 and the right eye backlight source 4064 in turn according to the 3D left eye backlight control signal 3 DBL and the 3D right eye backlight control signal 3 DBR for displaying the 3D images.

Figure 11:
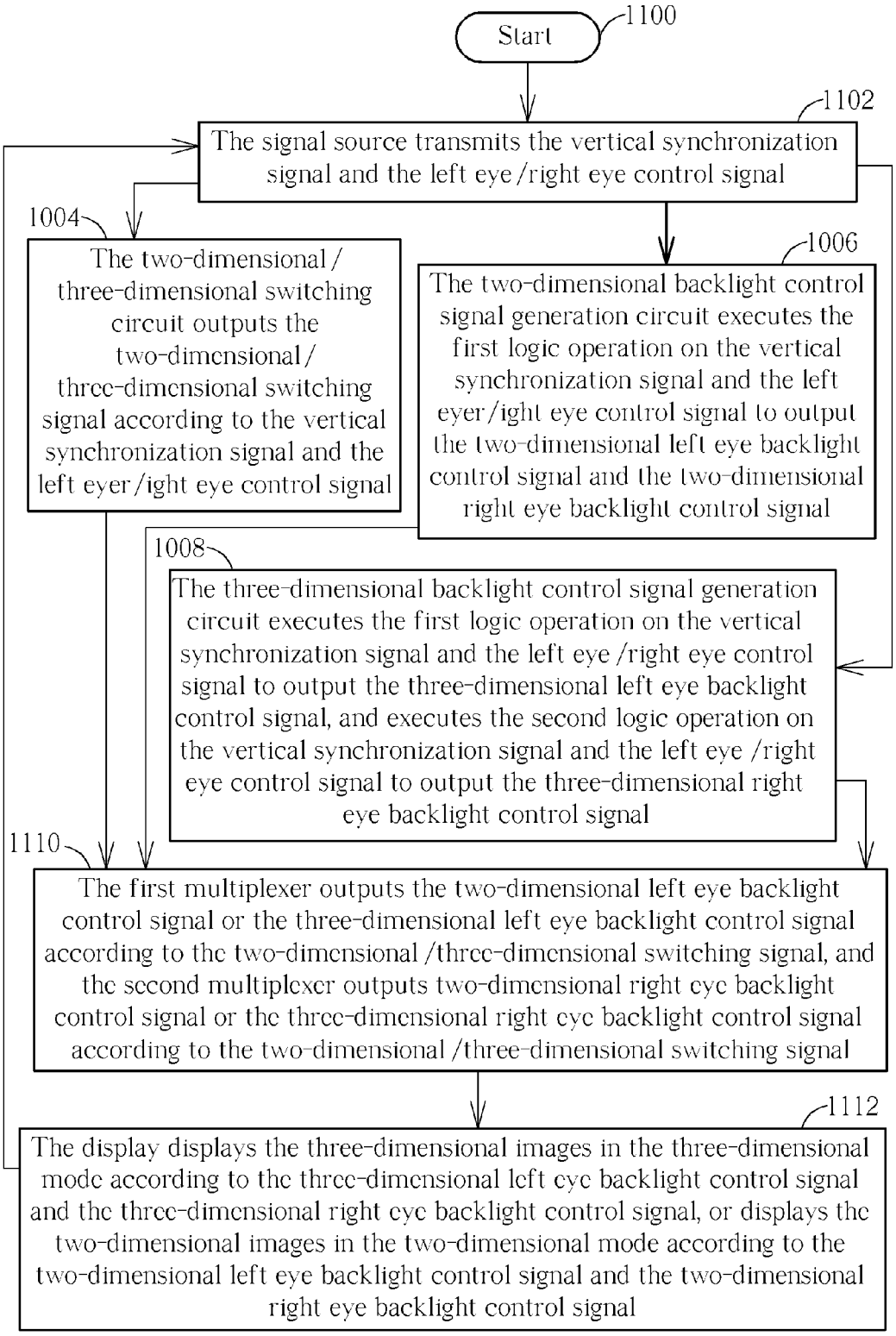
FIG. 11 is a flowchart illustrating a display method capable of switching 2D/3D mode according to another embodiment.

Please refer to FIG. 11. FIG. 11 is a flowchart illustrating a display method capable of switching 2D/3D mode according to another embodiment. The method in FIG. 11 uses the display system 600 in FIG. 6 to illustrate the method. Detailed steps are as follows:

Step 1100: Start.

Step 1102: The signal source 402 transmits the vertical synchronization signal VSYNC and the left eye/right eye control signal L/R.

Step 1104: The 2D/3D switching circuit 608 outputs the 2D/3D switching signal Y according to the vertical synchronization signal VSYNC and the left eye/right eye control signal L/R.

Step 1106: The 2D backlight control signal generation circuit 610 executes the first logic operation on the vertical synchronization signal VSYNC and the left eye/right eye control signal L/R to output the 2D left eye backlight control signal 2 DBL and the 2D right eye backlight control signal 2 DBR.

Step 1108: The 3D backlight control signal generation circuit 604 executes the first logic operation on the vertical synchronization signal VSYNC and the left eye/right eye control signal L/R to output the 3D left eye backlight control signal 3 DBL, and executes the second logic operation on the vertical synchronization signal VSYNC and the left eye/right eye control signal L/R to output the 3D right eye backlight control signal 3 DBR.

Step 1110: The first multiplexer 612 outputs the 2D left eye backlight control signal 2 DBL or the 3D left eye backlight control signal 3 DBL according to the 2D/3D switching signal Y, and the second multiplexer 614 outputs 2D right eye backlight control signal 2 DBR or the 3D right eye backlight control signal 3 DBR according to the 2D/3D switching signal Y.

Step 1112: The display 606 displays the 3D images in the 3D mode according to the 3D left eye backlight control signal 3 DBL and the 3D right eye backlight control signal 3 DBR, or displays the 2D images in the 2D mode according to the 2D left eye backlight control signal 2 DBL and the 2D right eye backlight control signal 2 DBR; go to Step 1102.

In Step 1104, the 2D/3D switching circuit 608 outputs the 2D/3D switching signal Y according to the vertical synchronization signal VSYNC and the left eye/right eye control signal L/R. In Step 1106, the first XOR gate 6102 of the 2D backlight control signal generation circuit 610 executes the exclusive-OR logic operation on the vertical synchronization signal VSYNC and the left eye/right eye control signal L/R to output the 2D left eye backlight control signal 2 DBL and the 2D right eye backlight control signal 2 DBR, where the timing of the 2D left eye backlight control signal 2 DBL is the same as the timing of the 2D right eye backlight control signal 2 DBR. In Step 1108, the XOR gate 6042 of the 3D backlight control signal generation circuit 604 executes the exclusive-OR logic operation on the vertical synchronization signal VSYNC and the left eye/right eye control signal L/R to output the 3D left eye backlight control signal 3 DBL, and the XNOR gate 6044 of the 3D backlight control signal generation circuit 604 executes the exclusive-NOR logic operation on the vertical synchronization signal VSYNC and the left eye/right eye control signal L/R to output the 3D right eye backlight control signal 3 DBR. In Step 1110, the first multiplexer 612 outputs the 2D left eye backlight control signal 2 DBL or the 3D left eye backlight control signal 3 DBL according to the logic voltage of the 2D/3D switching signal Y; and, the second multiplexer 614 outputs the 2D right eye backlight control signal 2 DBR or the 3D right eye backlight control signal 3 DBR according to the logic voltage of the 2D/3D switching signal Y. In Step 1112, the display 606 turns on the left eye backlight source 6062 and the right eye backlight source 6064 in turn according to the 3D left eye backlight control signal 3 DBL and the 3D right eye backlight control signal 3 DBR for displaying the 3D images, or turns on and turns off the left eye backlight source 6062 and the right eye backlight source 6064 simultaneously according to the 2D left eye backlight control signal 2 DBL and the 2D right eye backlight control signal 2 DBR for displaying the 2D images.

To sum up, the display system capable of switching 2D/3D mode and method thereof utilize a plurality of simple logic circuits to execute logic operations on the vertical synchronization signal and the left eye/right eye control signal for outputting the 3D left eye backlight control signal and the 3D right eye backlight control signal, or the 2D left eye backlight control signal and the 2D right eye backlight control signal. Therefore, the display can display the 3D image according to the 3D left eye backlight control signal and the 3D right eye backlight control signal, or displays the 2D image according to the 2D left eye backlight control signal and the 2D right eye backlight control signal. Thus, the present invention not only reduces cost of the directional backlight display system, but also reduces design complexity of the directional backlight display system.

Those skilled in the art will readily observe that numerous modifications and alterations of the device and method may be made while retaining the teachings of the invention.

What is claimed is:

1. A display system capable of switching two-dimensional (2D)/three-dimensional (3D) mode, the display system comprising:

a signal source for transmitting a vertical synchronization signal and a left eye/right eye control signal;

a 3D backlight control signal generation circuit coupled to the signal source for executing a first logic operation on the vertical synchronization signal and the left eye/right eye control signal to output a 3D left eye backlight control signal, and executing a second logic operation on the vertical synchronization signal and the left eye/right eye control signal to output a 3D right eye backlight control signal;

a 2D/3D switching circuit coupled to the signal source for outputting a 2D/3D switching signal according to the vertical synchronization signal and the left eye/right eye control signal;

a 2D backlight control signal generation circuit coupled to the signal source for executing a first logic operation on the vertical synchronization signal and the left eye/right eye control signal to output a 2D left eye backlight control signal and a 2D right eye backlight control signal;

a first multiplexer having a first input terminal for receiving the 2D/3D switching signal, a second input terminal for receiving the 2D left eye backlight control signal, a third input terminal for receiving the 3D left eye backlight control signal, and an output terminal for outputting the 2D left eye backlight control signal or the 3D left eye backlight control signal;

a second multiplexer having a first input terminal for receiving the 2D/3D switching signal, a second input terminal for receiving the 2D right eye backlight control signal, a third input terminal for receiving the 3D right eye backlight control signal, and an output terminal for outputting the 2D right eye backlight control signal or the 3D right eye backlight control signal; and a display for displaying 3D images in a 3D mode according to the 3D left eye backlight control signal and the 3D right eye backlight control signal, or displaying 2D images in a 2D mode according to the 2D left eye backlight control signal and the 2D right eye backlight control signal.

2. The display system of claim 1, wherein the 2D backlight control signal generation circuit comprises:

a first XOR gate having a first input terminal for receiving the vertical synchronization signal, a second input terminal for receiving the left eye/right eye control signal, and an output terminal for outputting the 2D left eye backlight control signal and the 2D right eye backlight control signal.

3. The display system of claim 1, wherein the 2D/3D switching circuit comprises:

a first flip-flop having a first input terminal for receiving the left eye/right eye control signal, a second input terminal for receiving the vertical synchronization signal, and a first output terminal for outputting a first signal;

a second flip-flop having a first input terminal for receiving the first signal, a second input terminal for receiving the vertical synchronization signal, and a first output terminal for outputting a second signal; and a second XOR gate having a first input terminal for receiving the first signal, a second input terminal for receiving the second signal, and an output terminal for outputting the 2D/3D switching signal.

4. The display system of claim 3, wherein the first flip-flop and the second flip-flop are D flip-flops.

5. The display system of claim 1, wherein the 3D backlight control signal generation circuit further comprises:

a third XOR gate having a first input terminal for receiving the vertical synchronization signal, a second input terminal for receiving the left eye/right eye control signal, and an output terminal for outputting the 3D left eye backlight control signal; and an XNOR gate having a first input terminal for receiving the vertical synchronization signal, a second input terminal for receiving the left eye/right eye control signal, and an output terminal for outputting the 3D right eye backlight control signal.

6. A 3D mode display method, wherein a 3D mode display system applied to the 3D mode display method comprises a signal source, a 3D backlight control signal generation circuit, and a display, wherein the 3D backlight control signal generation circuit comprises an XOR gate and an XNOR gate, the 3D mode display method comprising:

the signal source transmitting a vertical synchronization signal and a left eye/right eye control signal;

the XOR gate executing an exclusive-OR logic operation on the vertical synchronization signal and the left eye/right eye control signal to output a 3D left eye backlight control signal, and the XNOR gate executing a an exclusive-NOR logic operation on the vertical synchronization signal and the left eye/right eye control signal to output a 3D right eye backlight control signal; and the display displaying 3D images in a 3D mode according to the 3D left eye backlight control signal and the 3D right eye backlight control signal.

7. A display method capable of switching 2D/3D mode, wherein a display system capable of switching 2D/3D mode applied to the display method comprises a signal source, a 3D backlight control signal generation circuit, a 2D/3D switching circuit, a 2D backlight control signal generation circuit, a first multiplexer, a second multiplexer, and a display, wherein the 3D backlight control signal generation circuit comprises an XOR gate and an XNOR gate, the display method comprising:

the signal source transmitting a vertical synchronization signal and a left eye/right eye control signal;

the 2D/3D switching circuit outputting a 2D/3D switching signal according to the vertical synchronization signal and the left eye/right eye control signal;

the 2D backlight control signal generation circuit executing an exclusive-OR logic operation on the vertical synchronization signal and the left eye/right eye control signal to output a 2D left eye backlight control signal and a 2D right eye backlight control signal;

the XOR gate executing the exclusive-OR logic operation on the vertical synchronization signal and the left eye/right eye control signal to output a 3D left eye backlight control signal;

the XNOR gate executing an exclusive-NOR logic operation on the vertical synchronization signal and the left eye/right eye control signal to output a 3D right eye backlight control signal;

the first multiplexer outputting the 2D left eye backlight control signal or the 3D left eye backlight control signal, and the second multiplexer outputting the 2D right eye backlight control signal or the 3D right eye backlight control signal according to the 2D/3D switching signal; and the display displaying 3D images in a 3D mode according to the 3D left eye backlight control signal and the 3D right eye backlight control signal, or displaying 2D images in a 2D mode according to the 2D left eye backlight control signal and the 2D right eye backlight control signal.

* * * * *